US011969043B2

(12) United States Patent
Brose et al.

(10) Patent No.: US 11,969,043 B2
(45) Date of Patent: Apr. 30, 2024

(54) SKULL MOUNTING SYSTEM FOR HEADGEAR AND HEADGEAR WITH SKULL MOUNTING SYSTEM

(71) Applicant: SATA GmbH & Co. KG, Kornwestheim (DE)

(72) Inventors: Jens Brose, Ottmarsheim (DE); Marco Schönemann, Wendlingen (DE)

(73) Assignee: SATA GmbH & Co. KG, Kornwestheim (DE)

( * ) Notice: Subject to any disclaimer, the term of this patent is extended or adjusted under 35 U.S.C. 154(b) by 65 days.

(21) Appl. No.: 17/394,902

(22) Filed: Aug. 5, 2021

(65) Prior Publication Data

US 2022/0039499 A1 Feb. 10, 2022

(30) Foreign Application Priority Data

Aug. 7, 2020 (DE) ..... 20 2020 104596.2

(51) Int. Cl.
*A42B 1/002* (2021.01)

(52) U.S. Cl.
CPC ..... *A42B 1/002* (2013.01)

(58) Field of Classification Search
CPC .. A42B 3/08; A42B 3/085; A42B 3/14; A42B 3/142; A42B 3/145; A42B 3/147; A62B 17/04; A61F 9/06; A61F 9/045
See application file for complete search history.

(56) References Cited

U.S. PATENT DOCUMENTS 1,153,907 A * 9/1915 Halbert ..... A42C 5/02 2/181.8
1,170,052 A * 2/1916 Diener et al. ..... A42C 5/04 2/181.6
2,706,294 A * 4/1955 Sprinkle ..... A42B 3/14 2/414
2,739,309 A * 3/1956 Frieder ..... B29C 70/00 2/416
2,758,306 A * 8/1956 Grancsay ..... A42B 3/14 2/419

(Continued)

FOREIGN PATENT DOCUMENTS

CN 2820148 Y 9/2006
DE 3543341 A1 9/1986

(Continued)

OTHER PUBLICATIONS

Amazon.de search for "Textilgummiband", https://www.amazon.de/s?k=textilgummiband&_mk_de_DE=%C3%85M%C3%85%C5%BD%C3%95%C3%91&crid=K61H7LDW10DU&sprefix=textilgummiband%2Caps%2C142&ref=nb_sb_noss_2, Sep. 20, 2023 (Year: 2023).*

(Continued)

*Primary Examiner* — Heather Mangine
(74) *Attorney, Agent, or Firm* — Paul D. Bianco; Stephen Bongini; Fleit Intellectual Property Law

(57) ABSTRACT

A skull mounting system for headgear, preferably a respirator hood, includes a headband with a front headband and a rear headband. The front headband extends around at least the front of the head of the wearer and the rear headband is found on the back of the head of the wearer, and at least one upper headband is provided that extends over the top of the head of the wearer. The upper headband has higher elasticity than the front and rear headbands.

20 Claims, 4 Drawing Sheets

(56) References Cited

U.S. PATENT DOCUMENTS 2,796,609 A * 6/1957 Fisher ..... A42B 3/14 2/416
2,814,043 A * 11/1957 Alesi ..... A42B 3/14 2/421
2,879,513 A * 3/1959 Hornickel ..... A42B 3/14 2/414
2,921,318 A * 1/1960 Voss ..... A42B 3/14 2/416
3,075,201 A 1/1963 Lindblom
3,241,154 A * 3/1966 Aileo ..... A42B 3/10 2/419
3,555,560 A * 1/1971 Rascke ..... A42B 3/14 2/418
3,696,442 A 10/1972 Amundsen
3,994,023 A * 11/1976 Aileo ..... A42B 3/14 2/419
4,464,800 A 8/1984 Edwards
4,619,254 A * 10/1986 Moretti ..... A62B 17/04 128/201.23
4,621,377 A 11/1986 Pennell
4,888,831 A * 12/1989 Oleson ..... A42B 3/145 24/581.1
D316,164 S * 4/1991 Furthbauer ..... D2/894
5,150,479 A * 9/1992 Oleson ..... A42B 3/14 2/5
5,319,808 A * 6/1994 Bishop ..... A42B 3/14 2/181.2
5,608,917 A * 3/1997 Landis ..... A42B 3/14 2/418
5,898,949 A * 5/1999 Barthold ..... A42B 3/10 2/5
6,081,931 A * 7/2000 Burns ..... A42B 3/14 2/416
D484,436 S * 12/2003 Landry ..... D11/200
D501,956 S * 2/2005 Grepper ..... D29/122
8,336,114 B1 12/2012 Lee
8,505,121 B2 * 8/2013 Ahlgren ..... A42B 3/085 2/418
9,113,671 B2 * 8/2015 Pfanner ..... A42B 3/14
10,588,373 B2 3/2020 Staudinger
11,013,289 B1 * 5/2021 Lucero ..... A42B 3/30
11,096,439 B2 * 8/2021 King ..... A42B 3/145
11,793,260 B2 10/2023 Brose
2006/0156448 A1 * 7/2006 Garneau ..... A42B 3/085 2/10
2007/0245466 A1 * 10/2007 Lilenthal ..... A42B 3/14 2/416
2007/0245467 A1 * 10/2007 Lilenthal ..... A42B 3/225 2/416
2008/0109947 A1 * 5/2008 Dubois ..... A42B 3/145 2/414
2010/0050325 A1 * 3/2010 Wang-Lee ..... A42B 3/145 2/418
2010/0229286 A1 9/2010 Ahlgren
2010/0235971 A1 * 9/2010 Ahlgren ..... A42B 3/14 2/416
2011/0265254 A1 11/2011 Ma
2011/0289659 A1 12/2011 Lanez
2012/0144565 A1 6/2012 Huh
2013/0111653 A1 * 5/2013 Huh ..... A42B 3/14 2/421
2013/0219596 A1 * 8/2013 Carvell ..... A42B 3/14 2/416
2013/0239303 A1 * 9/2013 Cotterman ..... A42B 3/08 2/417
2014/0101828 A1 * 4/2014 Sugerman ..... A42B 3/145 2/418
2015/0059066 A1 * 3/2015 Ketterer ..... A42B 3/085 2/418
2015/0143618 A1 * 5/2015 Pereira ..... A42B 3/04 24/3.12
2015/0143669 A1 * 5/2015 Pereira ..... A42B 1/24 24/3.12
2015/0250251 A1 * 9/2015 Ahlgren ..... A42B 3/145 2/416
2015/0359677 A1 * 12/2015 Sommers ..... A42B 3/225 2/8.2
2016/0183622 A1 6/2016 Patel
2016/0249701 A1 * 9/2016 Xiong ..... A42B 3/085 2/421
2016/0262484 A1 * 9/2016 Huh ..... A42B 3/14
2016/0331059 A1 * 11/2016 Basson ..... A42B 3/222
2016/0361201 A1 * 12/2016 Sommers ..... A42B 3/06
2017/0112221 A1 * 4/2017 Gotti ..... A42B 3/145
2017/0112223 A1 * 4/2017 Gotti ..... A42B 3/14
2017/0150771 A1 * 6/2017 Huh ..... A42B 3/085
2017/0238643 A1 * 8/2017 Pereira ..... A42B 3/14
2017/0245578 A1 * 8/2017 Xiong ..... A42B 3/147
2017/0255027 A1 9/2017 Hofer-Kraner
2019/0029355 A1 1/2019 Seo
2019/0141847 A1 * 5/2019 Chang ..... G02B 27/00
2020/0022443 A1 * 1/2020 Wetzel ..... A42B 3/121
2020/0390182 A1 * 12/2020 Huh ..... A42B 3/142
2021/0037905 A1 * 2/2021 Ward ..... A42B 3/14
2021/0120904 A1 * 4/2021 Kühnlein ..... A42B 3/085
2021/0337909 A1 * 11/2021 Tolk ..... A42B 3/142
2021/0337911 A1 * 11/2021 Franke ..... A42B 3/10
2021/0378868 A1 * 12/2021 Huh ..... A61F 9/06
2022/0039499 A1 * 2/2022 Brose ..... A42B 1/002
2022/0039502 A1 * 2/2022 Brose ..... A42B 3/085
2022/0071334 A1 3/2022 Huang

FOREIGN PATENT DOCUMENTS

DE 102012000370 A1 8/2013
EP 2123182 A2 11/2009
EP 2207443 B1 9/2011
EP 3568031 A1 11/2019
EP 3815560 A1 * 5/2021 ..... A42B 3/145
GB 2098459 A 11/1982
GB 2098459 B 11/1982
JP 5899836 A 4/2016
JP 5899836 B2 4/2016
KR 101932245 B1 12/2018
WO 2009/048794 A1 4/2009
WO WO-2020111286 A1 * 6/2020
WO WO-2021216082 A1 * 10/2021

OTHER PUBLICATIONS

European Search Report for European Patent Application No. 21188232.9, dated Jan. 4, 2022.
European Search Report for European Patent Application No. 21188233.7, dated Jan. 5, 2022.
German Search Report dated May 28, 2021 for DE 10 2020 120 950.9 (8 pages).
German Search Report dated May 28, 2021 for DE 20 2020 104 596.2 (8 pages).
Response submitted May 10, 2023 for U.S. Appl. No. 17/394,741.
Office Action dated Feb. 10, 2023 for U.S. Appl. No. 17/394,741.
Notice of Allowance dated Jun. 9, 2023 for U.S. Appl. No. 17/394,741.

* cited by examiner

SKULL MOUNTING SYSTEM FOR HEADGEAR AND HEADGEAR WITH SKULL MOUNTING SYSTEM

FIELD OF THE DISCLOSURE

The disclosure relates to a skull mounting system for headgear, preferably a respirator hood, comprising a headband consisting of a material with limited elasticity, which consists of a front headband and a rear headband, wherein the front headband extends around at least around the front side of the head of a wearer and the rear headband is found on the back of the head of the wearer, and at least one upper headband is provided, which extends over the top of the head of the wearer.

The disclosure also relates to head gear with such a skull mounting system.

BACKGROUND

A skull mounting system according to the type mentioned above is disclosed in GB2098459B. The skull mounting system described there has a headband consisting of a front headband and a rear headband. A rubber-cushioned length compensation mechanism is provided between the front headband and the rear headband, which connects the front headband and the rear headband together and ensures that the headband is elastically expandable in length. An upper headband is also provided, which is connected by means of connection parts to the headgear, in this case a protective helmet. The upper headband consists of several individual straps and is intended to take up the force that develops during impact to the protective helmet.

SUMMARY

One aspect of the disclosure relates to a skull mounting system with improved wearing comfort.

Preferred embodiments are also disclosed herein

In one embodiment, the skull mounting system according to the disclosure for headgear, preferably a respirator hood, includes a headband with a front headband and a rear headband, wherein the front headband extends around at least the front of the head of the wearer and the rear headband is found on the back of the head of the wearer, and at least one upper headband is provided that extends over the top of the head of the wearer, wherein the upper headband has higher elasticity than the front and rear headbands.

The upper headband preferably also has lower rigidity or higher flexibility than the front and/or rear headbands.

The wearing comfort of the skull mounting system is significantly increased with the disclosed system. Additionally, accompanying phenomena, such as the cutting-in of the edges of the banding and pressure spots or bruises, can be prevented or reduced.

A component of higher elasticity is understood to mean a component that has a multiple length increase relative to a component of lower elasticity in the direction of elongation during the application of a force. The direction of elongation is the direction of the corresponding component in which the component is mostly stressed during the intended use.

The direction of elongation in the front, rear and upper headbands correspond to the length direction of the bands. The elasticity of the bands is particularly dependent on the geometry (length, width, thickness, recesses, grooves, etc.) and on the employed material.

It is particularly advantageous if the upper headband consists of a rubbery material. The forces that occur, for example, by movement of the wearer's head, can be cushioned with particular comfort by a rubber-elastic headband.

The upper headband preferably consists of 71% polyethersulfone (PES) and 29% elastodiene and preferably has an elongation above 10%, preferably above 50% and an elongation below 150%, especially an elongation of 95%. The material thickness of the upper headband is preferably between 1 millimeter and 3 millimeters, the width preferably between 20 millimeters and 40 millimeters. The upper headband is especially a textile rubber strap.

The rear band is preferably made from a material different from that of the front and upper headband, especially the rear headband is made from a more wear-resistant material than the front and/or upper headband. The material of the front headband preferably has a lower torsion and bending strength than the material of the rear headband.

It is particularly advantageous if the material from which the front headband is made is a fiber-reinforced plastic. The Shore hardness of the front headband is advantageously more than 5 Shore-D and less than 70 Shore-D, especially less than 60 Shore-D.

The material from which the front headband is made is preferably a thermoplastic elastomer, preferably with a surface resistance between $10^4$ and $10^9\Omega$. The average material thickness of the front headband, for example, is between 2 millimeters and 4 millimeters, the width between 20 millimeters and 40 millimeters.

The material from which the rear headband is made is preferably a polyamide with a modulus of elasticity between 600 MPa and 2000 MPa. The Shore hardness of the rear headband is advantageously more than 80 Shore-D, particularly more than 83 Shore-D and less than 120 Shore-D. The surface of the cross section of the rear headband amounts to more than 1% of the cross-sectional surface of the front headband and no more than 50%, preferably no more than 30%.

It is particularly advantageous if several upper headband sections, particularly three upper headband sections, are guided over the top of the head of the wearer, wherein preferably the lengths of the upper headband sections overlap once and/or the upper headband sections form a coherent upper headband. It is particularly advantageous if the upper headband sections are connected to each other at the ends, preferably in one piece. A particularly simple and therefore cost-effective solution is provided by this configuration.

The unloaded front headband preferably has a convex arch at least in areas, extending along the length of the front headband in an area that can come into direct or indirect contact with the forehead of the wearer when worn. The cutting-in of the edges of the front headband is prevented by such arching.

It is also particularly advantageous if the unloaded front headband has a concave arch at least in areas that can come into direct or indirect contact with the lateral sides of the head of the wearer while worn, in which case the arch extends along the length of the front headband. It is particularly advantageous if the convex arch changes to an opposite arch toward the top and bottom of the front headband. Contact on the head of the wearer is improved by this embodiment.

It is also advantageous if the convex arch and/or the concave arch deforms with a reduction in arching or opposite the arching, when forces act on the front headband in the longitudinal direction, and/or recesses are provided on the headband in the longitudinal direction that are preferably suitable for increasing the elasticity or flexibility of the headband in the vertical direction. Such forces occur, in particular, when the headband is worn by the wearer, the headband being fastened on the wearer's head by a reduction of the inner circumference. A particularly good fit on the wearer's head is achieved by changing the cross-sectional geometry of the front headband.

The front headband is preferably configured so that in the area arranged on the temples of the wearer when worn, partly does not come in contact with the head of the wearer. The term temples does not refer to the anatomical region of the temporal bone, but the area commonly designated as the temples and which is particularly pressure-sensitive. It therefore means an area that lies cranially above the transversal plane at eye level roughly in the area at which the frontal bone contacts the parietal bone. The inside of the front headband can be at least partially back-set in this area (back offset area). The front headband in this area can also have less flexibility than in the adjacent areas. The pressure on the sensitive area of the temples is reduced by this embodiment, which improves wearing comfort.

It is particularly preferred that the rear headband is connected to the front headband by means of swivel joints, preferably in which the swivel joints can be firmly locked in several rotary positions. It is also preferred if the rear headband has a length adjustment by means of which the length of the rear headband can be adjusted. Optimal fit of the headband on the head of the wearer is achieved by such an embodiment.

For fastening of the skull mounting system on the head of the wearer, it is advantageous if the force on the back of the head of the wearer acts in the lower area of the back of the head, since the skull mounting system is thereby pulled further downward. For this purpose, the locking of the swivel joints is necessary. In this connection, it is also particularly advantageous if the rear headband has high rigidity in order to keep the rear headbands in the correct position even during the application of a force. The length adjustment serves to change the inner circumference so that the skull mounting system can be fastened on the head of the wearer. The wearing comfort and fastening of the skull mounting system are therefore improved by the described embodiment.

The front headband can have end sections that extend in the direction of the back of the head when the skull mounting system is worn after a connection point at which the front headband and the rear headband are connected to each other. Fastening to the head gear and to the upper headband is created by such end sections, by means of which the applied forces can be particularly well distributed.

It is advantageous that the upper head band is guided by connection slits in the front headband, preferably in which the ends of the upper headband are loosely clamped into the connection slits on the front headband, so that the length of the upper headband can be adjusted by loosening the clamping. By adjusting the length of the upper headband, the distance between the headgear and skull mounting system can be changed particularly simply and adapted to the shape and size of the head.

The upper headband can be configured wherein it is guided by front connection slits in the front headband in the area arranged on the temples of the wearer when worn and/or wherein the upper headband is guided by rear connection slits on the front headband. The rear connection slits are preferably situated in the end sections of the front headband, which extend in the direction of the back of the head when the skull mounting system is worn after a connection point at which the front headband and the rear headband are connected to each other. A particularly advantageous force distribution can thus be achieved.

The front headband can be configured wherein it has front connection devices for connection to the headgear in the area arranged on the temples of the wearer when worn, which extend upward, and/or wherein two rear connection devices are provided for connection to the headgear. The rear connection devices are preferably situated in the end sections of the front headband that extend in the direction of the back of the head when the skull mounting system is worn after a connection point at which the front headband and the rear headband are connected to each other. A particularly good force transfer between the skull mounting system and headgear is achieved by the corresponding connection devices.

Rear connection devices for connection to the headgear can preferably be provided, which are formed by longitudinal slits into which a fastening part of the headgear can engage, wherein preferably the fastening part can be arranged to be movable along the longitudinal slits. A length compensation between the headband and the headgear can occur through the longitudinal slits so that adjustment to different head sizes and head shapes is made possible.

A headgear, especially a respirator hood with a described skull mounting system, is particularly advantageous, since it is generally worn continuously over long periods of time and the wearing comfort is improved by such a skull mounting system.

BRIEF DESCRIPTION OF THE DRAWINGS

A more complete understanding of the present disclosure, and the attendant advantages and features thereof, will be more readily understood by reference to the following description of embodiment examples when considered in conjunction with the accompanying drawings wherein.

DETAILED DESCRIPTION

Figure 1:
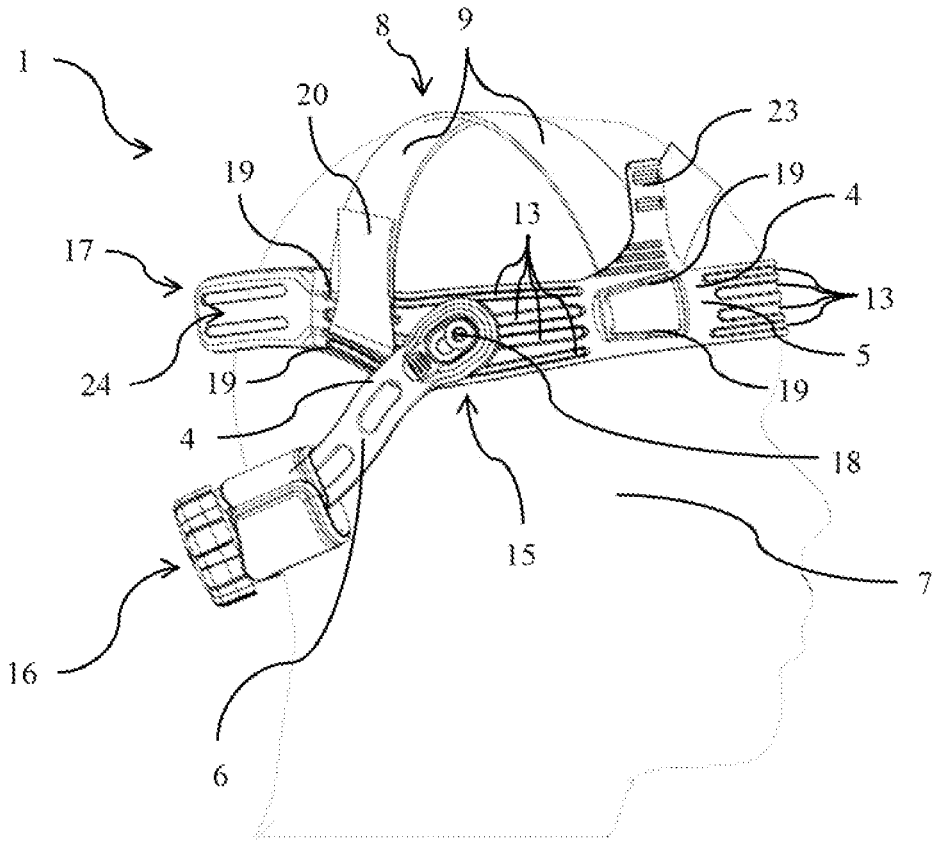
FIG. 1 shows a side view of a skull mounting system on the head of a wearer.
Figure 2:
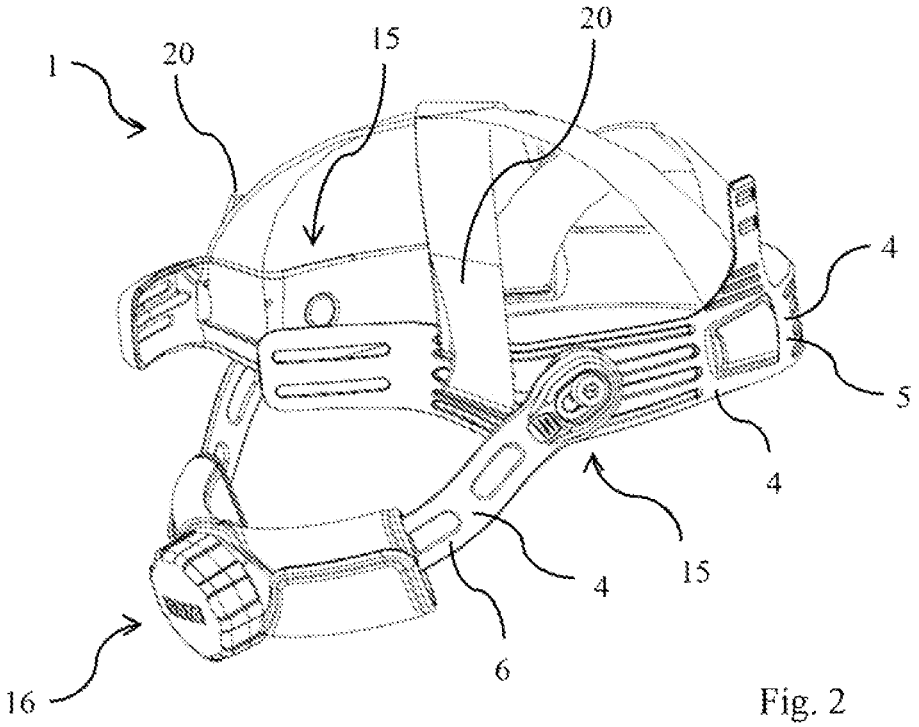
FIG. 2 shows a perspective view of a skull mounting system.
Figure 7:
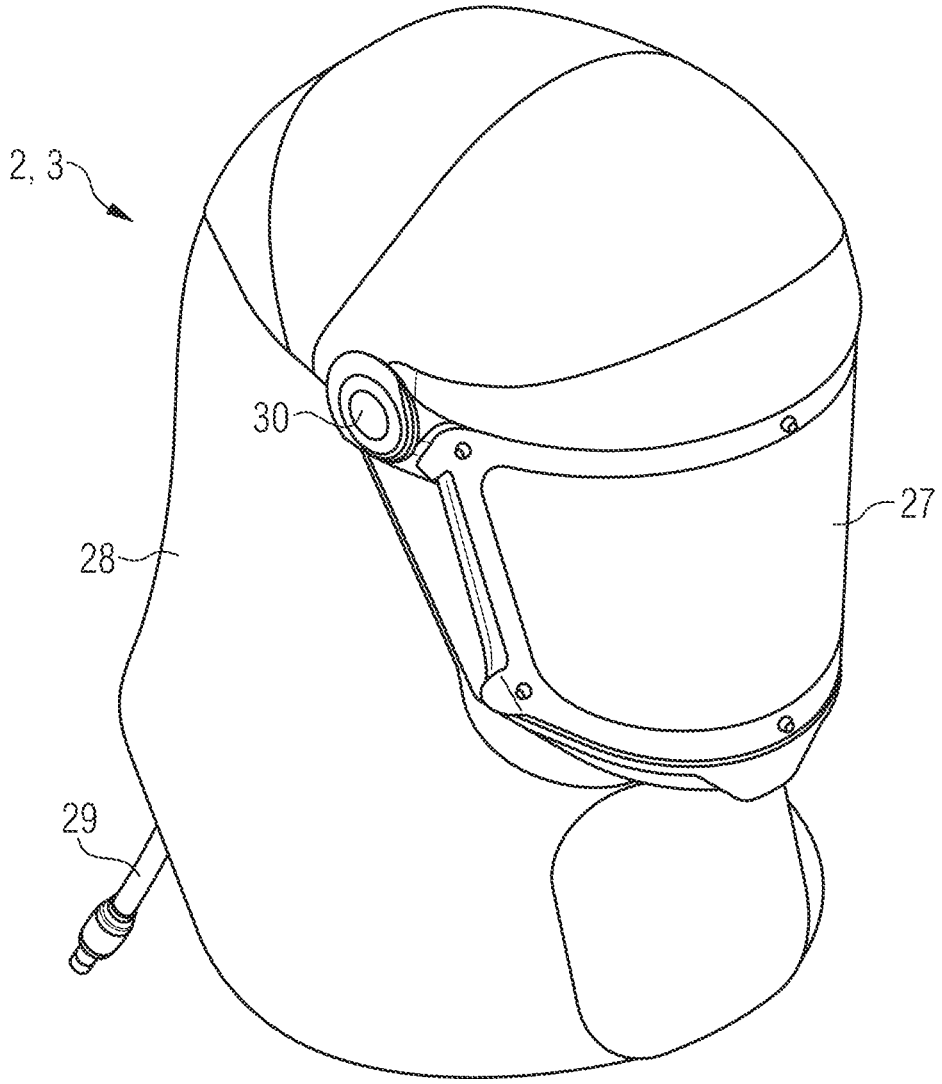
FIG. 7 shows a perspective view of a respirator hood.

FIGS. 1 and 2 show a skull mounting system 1 for headgear 2 depicted in FIG. 7, preferably a respirator hood 3 (FIG. 7). It has a headband 4 from components with lower elasticity, consisting of a front headband 5 and a rear headband 6, the front headband 5 extending around at least the front of the head 7 of a wearer and the rear headband 6 being situated on the back of the head 7 of the wearer. At least one upper headband 8 is provided, which extends over the top of the head 7 of the wearer and has higher elasticity. The upper headband 8 is rubber-elastic in the depicted embodiment example.

Several upper headband sections 9, specifically three upper headband sections 9 are shown, which are guided over the top of the head 7 of the wearer. The lengths of the upper headband sections 9 intersect once and form a coherent one-piece upper headband 8.

It is also shown that the rear headband 6 is connected by means of swivel joints 15 to the front headband 5. The swivel joints 15 can be firmly locked in several rotational positions. The rear headband 6 has a length adjustment 16, by means of which the length of the rear headband 6 can be adjusted.

The front headband 5 has end section 17 that extend in the direction of the back of the head after a connection point 18 at which the front headband 5 and the rear headband 6 are connected to each other.

It is also shown that the upper headband 8 is guided by connection slits 19 in the front headband 5. The ends of the upper headbands 20 are loosely clamped into the connection slits 19 on the front headband 5, so that the length of the upper headband 8 can be adjusted by loosening the clamping.

Figure 3:
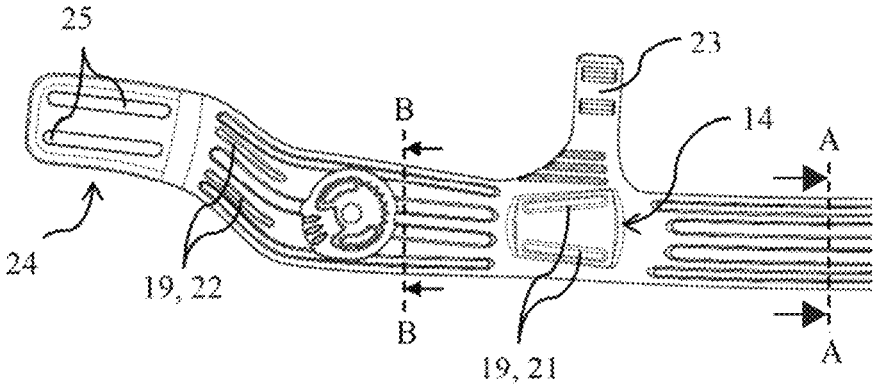
FIG. 3 shows a partial view of the headband in a stretched state.
Figure 4:
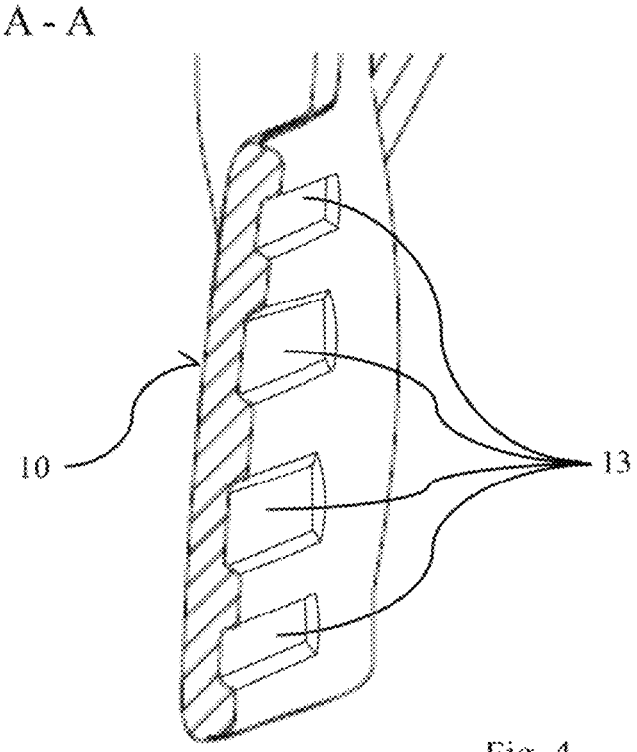
FIG. 4 shows a sectional view of the headband in the forehead area.
Figure 5:
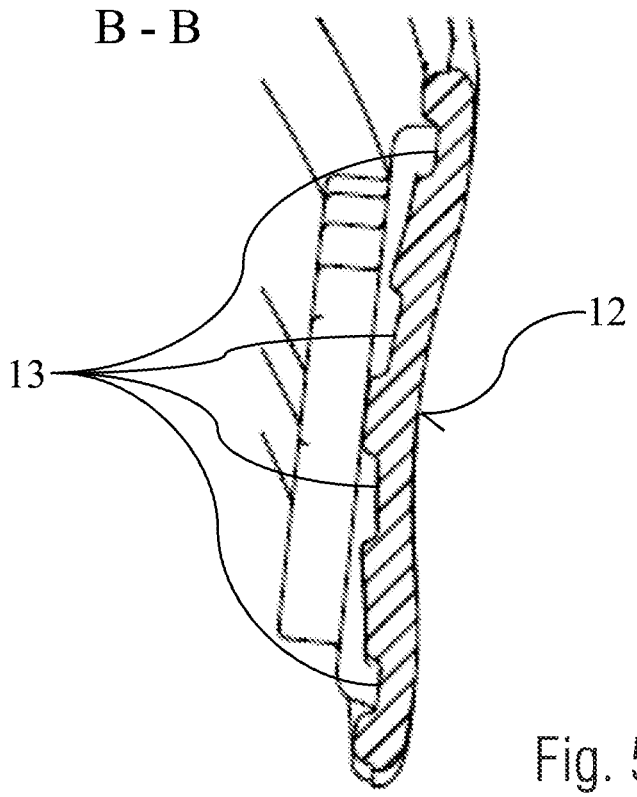
FIG. 5 shows a sectional view of the headband in the temple area.

A front headband 5 is shown in FIG. 3 in the stretched state, wherein FIGS. 4 and 5 show sectional views drawn in this figure.

It is also shown in FIG. 3 that the inside of the front headband 5 is at least partially backset in an area 14 arranged on the temples 26 of the wearer when worn. Due to this measure, the back offset area 14 does not come in contact with the head 7 of the wearer when the skull mounting system 1 is worn. In addition, the front headband 5 has lower flexibility in this back offset area 14 than in the adjacent areas. As is apparent from FIG. 1, this is achieved in that recesses 13 that are incorporated in other areas of the front headband 5 are not incorporated in this area 14.

The upper headband 8 is configured so that it is guided by front connection slits 21 in the front headband 5 in the area arranged on the temples 26 of the wearer when worn. The upper headband 8 is also guided by rear connection slits 22 in the front headband 5. The rear connection slits 22 are situated in the end sections 17 of the front headband 5, wherein the end sections 17 extend in the direction of the back of the head after the connection point 18 depicted in FIG. 1, at which the front headband 5 and the rear headband 6 are connected to each other.

The front headband 5 is configured so that it has front connection devices 23 for connection to headgear 2, which extend upward in the area arranged on the temples 26 of the wearer when worn. Two rear connection devices 24 for connection to the headgear 2 are also shown, which are found in the area of the end section 17, in which case the end sections extend in the direction of the back of the head after the connection point 18 depicted in FIG. 1, at which the front headband 5 and the rear headband 6 are connected to each other.

FIG. 3 also shows that the front headband 5 has rear connection devices for connection to headgear 2, which are formed by longitudinal slits 25, into which a fastening part (not shown) of headgear 2 can engage. The fastening part here is arranged movable along the longitudinal slit 25.

As is apparent from FIG. 4, the front headband 5 has a convex arch 10 at least in areas extending along the length of the front headband 5 in an area that can directly or indirectly come in contact with the forehead of the wearer when worn.

Figure 6:
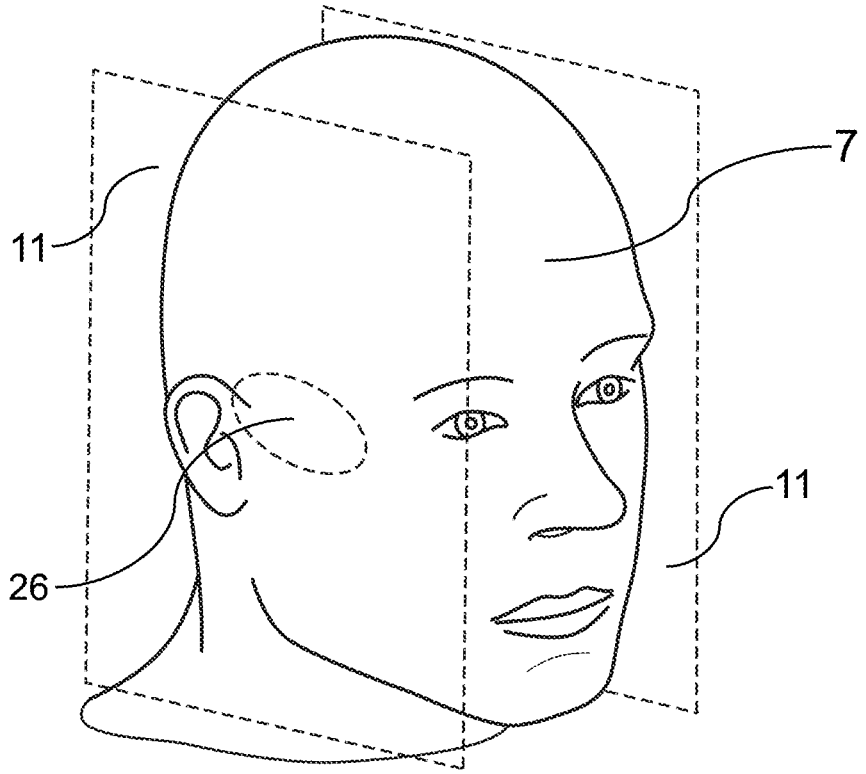
FIG. 6 shows a perspective view of the head of a wearer.

It is apparent from FIG. 5 that the unloaded front headband 5 has a concave arch 12 at least in areas extending along the length of the front headband 5 in an area that can directly or indirectly come in contact with the lateral sides 11 of the head 7 of the wearer depicted in FIG. 6 when worn.

The front headband 5 here is configured so that the convex arch 10 and/or the concave arch 12 is deformed relative to arch 10, 12 when forces are applied in the longitudinal direction on the front headband 5. In order to facilitate this, the headband 4 has the recesses 13 in the longitudinal direction depicted in FIGS. 1, 4 and 5, which are suitable for increasing the flexibility of headband 4 in the vertical direction.

FIG. 6 shows the head 7 of a wearer with temples 26 and the lateral sides of the wearer's head 11.

FIG. 7 shows a respirator hood 3, which is fastened to the head 7 of a wearer by the skull mounting system 1 described above. For this purpose, the skull mounting system 1 is connected to the respirator hood 3 by means of the front connection devices 23 and the rear connection devices 24. The rear connection devices 24 are formed in the area of the back of the head by slits into which a counter connection device (not shown) on the respirator hood 3 engages and is mounted movable in the longitudinal direction.

It is further shown that a corresponding respirator hood 3 preferably has a visor 27, the visor 27 being clear and transparent in the visual field. The visor 27 is connected to the skull mounting system 1 by means of two additional swivel joints 30, directly or indirectly, and can be tilted upward by means of the additional swivel joints 30. Here, it is advantageous if the transparent part of the visor 27 can be easily changed in order to replace it with a new part when it becomes soiled. The transparent part is made from a clear, transparent plastic part.

The respirator hood 3 also has a hood cover 28, which delimits the respirator hood 3 at least in areas in the form of an enclosure, so that an overpressure develops in the respirator hood 3, preventing particles or pollutants from penetrating into the internal area of the respirator hood 3 from the outside. For this purpose, the respirator hood 3 is supplied compressed air by means of a compressed air connection 29.

It should be understood that the present invention has a plurality of different features which may be utilized separately or in various combinations. It is also contemplated that the various features of the invention may be utilized with known features from the prior art. Although specific combination of features have been described herein, it is contemplated that other combinations of features will be apparent to those skilled in the art and will be formed.

Furthermore, although certain applications are described herein, those of ordinary skill in the art will appreciate other applications for the present invention.

In view of the foregoing, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

The invention claimed is:

1. A skull mounting system for headgear, the skull mounting system comprising a headband that includes:

a front headband and a rear headband, the front headband configured for extending around at least a front of a head of a wearer of the skull mounting system and the rear headband configured for arrangement on a back of the head of the wearer; and at least one upper headband configured for extending over a top of the head of the wearer, wherein the at least one upper headband has a higher elasticity than the front headband and a higher elasticity than the rear headband, the at least one upper headband comprises a textile rubber strap, the rear headband is made from a first material and the front headband is made from a second material that extends along an entire length of the front headband, the second material being different from the first material, and the second material of the front headband has a lower torsion and bending strength than the first material of the rear headband.

2. The skull mounting system of claim 1, wherein the higher elasticity of the at least one upper headband is in a longitudinal direction of the at least one upper headband, and the first material of the rear headband is a more wear resistant material than the second material of the front headband.

3. The skull mounting system of claim 1, wherein the at least one upper headband comprises a plurality of upper headband sections, and the plurality of upper headband sections is configured for guiding over the top of the head of the wearer.

4. The skull mounting system of claim 3, wherein lengths of the plurality of upper headband sections overlap, and the plurality of upper headband sections form a coherent upper headband.

5. The skull mounting system of claim 1, wherein, when not being worn, the front headband forms a concave arch at least in areas that are configured for directly or indirectly contacting lateral sides of the head of the wearer when being worn.

6. The skull mounting system of claim 1, wherein the front headband is configured so that at least one of a convex arch and a concave arch of the front headband is deformed with a reduction in arching, when forces act in a longitudinal direction on the front headband.

7. The skull mounting system of claim 1, wherein the front headband is configured so that at least part of the front headband does not contact the head of the wearer in a temple area when being worn.

8. The skull mounting system of claim 7, wherein an inside of the front headband in a back offset area is at least partially backset, and the front headband in the back offset area has lesser flexibility than in areas adjacent thereto.

9. The skull mounting system of claim 1, wherein the rear headband is connected to the front headband by swivel joints.

10. The skull mounting system of claim 9, wherein the swivel joints are lockable in a plurality of rotational positions.

11. The skull mounting system of claim 1, wherein the front headband has end sections extending in a direction of the back of the head, when the headband is worn, beyond a connection point at which the front headband is connected to the rear headband.

12. The skull mounting system of claim 1, wherein the at least one upper headband is guided through connection slits in the front headband, and the at least one upper headband is clamped into the connection slits in the front headband such that a length of the at least one upper headband is adjustable by loosening the clamping and sliding a portion of the at least one upper headband through the connection slits.

13. The skull mounting system of claim 1, wherein the front headband includes front connection devices configured for connection to the headgear in an area on temples of the wearer when being worn, which extend upward, and the front headband includes rear connection devices configured for connection to the headgear arranged in an area of end sections of the front headband, the end sections extending in a direction of the back of the head, when the headband is worn, beyond a connection point at which the front headband is connected to the rear headband.

14. The skull mounting system of claim 1, wherein the front headband has rear connection devices formed as longitudinal slits and configured for connection to the headgear.

15. The skull mounting system of claim 14, wherein a connection of the rear connection devices to the headgear is movable within the longitudinal slits.

16. The skull mounting system of claim 1, wherein the skull mounting system comprises the headgear.

17. The skull mounting system of claim 1, wherein a plurality of recesses are arranged on the front headband, the plurality of recesses extending in the longitudinal direction along a portion of the front headband, and the plurality of recesses being configured for increasing flexibility of the front headband in a vertical direction.

18. A skull mounting system for headgear, the skull mounting system comprising a headband that includes:

a front headband and a rear headband, the front headband configured for extending around at least a front of a head of a wearer of the skull mounting system and the rear headband configured for arrangement on a back of the head of the wearer; and at least one upper headband configured for extending over a top of the head of the wearer, wherein the at least one upper headband has a higher elasticity than the front headband and a higher elasticity than the rear headband, and when not being worn, the front headband has a cross-sectional profile including a convex arch configured for facing a forehead of the wearer when being worn, the profile extending in a longitudinal direction along a portion of the front headband that is configured for facing the forehead of the wearer when being worn.

19. The skull mounting system of claim 18, wherein the at least one upper headband comprises rubber-elastic.

20. A skull mounting system for headgear, the skull mounting system comprising a headband that includes:

a front headband and a rear headband, the front headband configured for extending around at least a front of a head of a wearer of the skull mounting system and the rear headband configured for arrangement on a back of the head of the wearer; and at least one upper headband configured for extending over a top of the head of the wearer, wherein the at least one upper headband has a higher elasticity than the front headband and a higher elasticity than the rear headband, the at least one upper headband comprises a textile rubber strap, the at least one upper headband is guided through rear connection slits in the front headband, and the rear connection slits are arranged in end sections of the front headband that extend in a direction of the back of the head, when the headband is worn, beyond a connection point at which the front headband is connected to the rear headband.

* * * * *